US006881704B2

(12) United States Patent
Sakamoto et al.

(10) Patent No.: US 6,881,704 B2
(45) Date of Patent: Apr. 19, 2005

(54) THERMAL TRANSFER IMAGE-RECEIVING SHEET

(75) Inventors: Kenji Sakamoto, Shinjuku-Ku (JP); Kazushi Kimura, Shinjuku-Ku (JP); Takenori Omata, Shinjuku-Ku (JP); Tatsuya Kita, Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 132 days.

(21) Appl. No.: 10/200,575

(22) Filed: Jul. 23, 2002

(65) Prior Publication Data

US 2003/0162660 A1 Aug. 28, 2003

(30) Foreign Application Priority Data

Jul. 25, 2001 (JP) ..... 2001-223991
Aug. 29, 2001 (JP) ..... 2001-259896

(51) Int. Cl.[7] ..... B41M 5/035; B41M 5/38
(52) U.S. Cl. ..... 503/227; 428/32.39; 428/32.5
(58) Field of Search ..... 428/32.39, 32.5; 503/227

(56) References Cited

U.S. PATENT DOCUMENTS 4,965,240 A * 10/1990 Imoto ..... 503/227
6,620,765 B1 * 9/2003 Idehara et al. ..... 503/227

* cited by examiner

*Primary Examiner*—Bruce H. Hess
(74) *Attorney, Agent, or Firm*—Parkhurst & Wendel, L.L.P.

(57) ABSTRACT

There is provided a thermal transfer image-receiving sheet which can yield, on its receptive layer, a thermally transferred sublimation dye image possessing excellent resistance to hand cream, resistance to sebum, resistance to plasticizers, and resistance to fats and oil. The thermal transfer image-receiving sheet comprises: a substrate sheet; and, provided on at least one side of the substrate sheet in the following order, an intermediate layer and a dye-receptive layer, the intermediate layer comprising a resin layer comprising an inorganic pigment having an acicular crystal structure.

12 Claims, No Drawings

THERMAL TRANSFER IMAGE-RECEIVING SHEET

BACKGROUND OF THE INVENTION

1. Field of the Invention

The present invention relates to a thermal transfer image-receiving sheet which can receive a colorant transferred from a thermal transfer sheet upon heating. More particularly, the present invention relates to a thermal transfer image-receiving sheet which can yield sublimation transferred images on a receptive layer having excellent (improved) resistance to hand cream, resistance to sebum, particularly sebum of human's nose, cheek, and forehead portions, resistance to plasticizers, and resistance to fats and oils.

2. Prior Art

In recent years, a system, wherein video photographed images, television images, and static images such as computer graphics are directly printed in a full color form, has been advanced, and the market of this system has been rapidly expanded. Among others, attention has been drawn to a system wherein a sublimable dye is provided as a recording material and is put on top of an image-receiving sheet and the assembly is heated by means of a thermal head in response to a recording signal to transfer the dye onto the image-receiving sheet, whereby a recorded image is formed. In this recording system, since the colorant is a dye which is very vivid and highly transparent, the formed images have excellent reproduction of intermediate colors and gradation and have the same quality as images formed by conventional full-color offset printing and gravure printing and have high quality comparable with photographic images. Further, the provision of a protective layer by thermal transfer on the receptive layer with a dye image formed thereon has been extensively adopted for enhancing fastness or resistance properties of thermally transferred prints, such as abrasion resistance and lightfastness.

The sublimation transferred images have excellent durability (fastness or resistance properties), but on the other hand, suffer from the following drawbacks. Specifically, when the image formed face is in contact, for example, with hand cream (a material containing a humectant/rough skin preventive component, such as commercially available Mentholatum (trademark)) or sebum, particularly sebum of human's nose, cheek, and forehead portions, for a long period of time, the fat-and-oil component contained in them penetrates through the surface of the protective layer and reaches the receptive layer or the intermediate layer. In this case, when distortion caused by heating at the time of printing exists in the intermediate layer, the distortion is released and cracking occurs in the intermediate layer, as well as in the overlying receptive layer and protective layer. In particular, when the protective layer exists, fine cracks are formed in the printed face, disadvantageously resulting in significantly deteriorated image quality.

Further, when the image formed face is in contact with a plasticizer or a plasticizer-containing material, for example, when the images are stored in a soft vinyl chloride resin file, when the images are in contact with a plastic eraser or the like for a long period of time, or when fats and oils, such as machine oils or castor oils, are in the state of deposition on the images for a long period of time, as with the above case, the plasticizer component or the fat-and-oil component penetrates through the surface of the protective layer and this causes fine cracking in the printed face, disadvantageously resulting in significantly deteriorated image quality.

For example, the use of a flexible resin or a highly soft resin in the intermediate layer or receptive layer has hitherto been made as a measure for preventing cracking. In this method, however, when the print is stored for a long period of time, for example, blurring of pixels of the image disadvantageously occurs. Further, when a highly flexible or soft resin in the protective layer is used, for some printing conditions in the transfer of the protective layer, poor transferability of the resin poses problems including that the appearance of the print is deteriorated and broken pieces of the resin are left as refuse in the printer, leading to a transfer failure in the preparation of a next print.

SUMMARY OF THE INVENTION

It is an object of the present invention to solve the above problems of the prior art and to provide a thermal transfer image-receiving sheet which can yield sublimation transferred images having excellent resistance to hand cream and resistance to sebum by virtue of increased coating strength of an intermediate layer. It is another object of the present invention to provide a thermal transfer image-receiving sheet which can yield sublimation transferred images having excellent resistance to plasticizers and resistance to fats and oils.

According to the present invention, there is provided a first thermal transfer image-receiving sheet comprising: a substrate sheet; and, provided on at least one side of the substrate sheet in the following order, an intermediate layer and a dye-receptive layer, said intermediate layer comprising a resin layer comprising an inorganic pigment having an acicular crystal structure (hereinafter referred to simply as "acicular pigment"). Preferably, the content of the acicular pigment in the intermediate layer is 20 to 300 parts by weight based on 100 parts by weight of the resin constituting the intermediate layer. The acicular pigment is preferably in the form of inorganic particles such as titanium oxide or potassium titanate particles. Preferably, the intermediate layer further comprises the resin layer comprising the inorganic pigment having an acicular crystal structure and flaky particles of talc or the like.

According to the present invention, there is provided a second thermal transfer image-receiving sheet comprising: a substrate sheet; and, provided on at least one side of the substrate sheet in the following order, an intermediate layer and a dye-receptive layer, said intermediate layer comprising a resin layer comprising flaky particles having an average particle diameter equal to or less than 6.0 $\mu$m and a thickness equal to or less than the half of the average particle diameter. Preferably, the content of the flaky particles in the intermediate layer is 20 to 100 parts by weight based on 100 parts by weight of the resin constituting the intermediate layer. The flaky particles are preferably inorganic particles of talc, mica or the like.

In the first and second thermal transfer image-receiving sheets of the present invention, more preferably, the resin layer comprises an adhesive resin selected from the group comprising urethane, polyolefin, polyester, acrylic and epoxy adhesive resins. More preferably, the dye-receptive layer comprises a metal source comprising a complex compound of a transition metal ion.

DETAILED DESCRIPTION OF THE INVENTION

Each layer constituting the thermal transfer image-receiving sheets according to the present invention will be described.

Substrate Sheet

The substrate sheet functions to hold the receptive layer and, at the same time, preferably can withstand heat applied at the time of image formation and has mechanical properties satisfactory for handling. Materials for such substrate sheets are not particularly limited, and examples thereof include films or sheets of various plastics, for example, polyesters, polyallylates, polycarbonates, polyurethanes, polyimides, polyether imides, cellulose derivatives, polyethylens, ethylene-vinyl acetate copolymers, polypropylenes, polystyrenes, acrylic polymers, polyvinyl chlorides, polyvinylidene chlorides, polyvinyl alcohols, polyvinyl butyrals, nylons, polyether ether ketons, polysulfones, polyether sulfones, tetrafluoroethylen-perfluoroalkyl vinyl ether copolymers, polyvinyl fluorides, tetrafluoroethylene-ethylene copolymers, tetrafluoroethylene-hexafluoropropylene copolymers, polychlorotrifluoroethylenes, and polyvinylidene fluorides.

The above plastic films or sheets, white films formed by adding white pigments or fillers to these synthetic resins and forming films from the mixtures, sheets comprising a substrate sheet having in its inside microvoids, and other materials, for example, capacitor papers, glassine papers, parchment papers, synthetic papers, such as polyolefin and polystyrene papers, wood free papers, art papers, coated papers, cast coated papers, synthetic resin- or emulsion-impregnated papers, synthetic rubber latex-impregnated papers, papers with synthetic resin internally added thereto, cellulose fiber papers and the like may be used. Further, laminates of any combination of the above substrate sheets may also be used. Representative examples thereof include a laminate of a combination of a cellulose fiber paper with a synthetic paper and a laminate of a combination of a cellulose fiber paper with a plastic film.

Furthermore, substrate sheets of which the surface and/or the backside have been subjected to easy-adhesion treatment may also be used. The thickness of the substrate sheet is generally about 3 to 300 $\mu$m. In the present invention, the use of a substrate sheet having a thickness of 75 to 175 $\mu$m is preferred from the viewpoint of suitable mechanical properties and the like. When the adhesion between the substrate sheet and the layer overlying the substrate sheet is poor, the surface of the substrate sheet is preferably subjected to easy-adhesion treatment or corona discharge treatment.

Intermediate Layer

The intermediate layer constituting the first thermal transfer image-receiving sheet according to the present invention is an acicular pigment-containing resin layer. In the present invention, the acicular pigment preferably has an average length (average major axis) of not more than 20.0 $\mu$m and an average diameter (average minor axis) of not more than 0.5 $\mu$m. The average length of the acicular pigment is more preferably not more than 15.0 $\mu$m. Among these acicuiar pigments, particularly preferred acicular pigments have an average length of 1.5 to 15.0 $\mu$m, an average diameter of 0.1 to 0.5 $\mu$m, and an aspect ratio (average length/average diameter) of about 10 to 35.

Specific examples of preferred acicular pigments usable herein include titanium oxide available from Ishihara Sangyo Kaisha Ltd. under the tradename designations FTL-100, FTL-200, FTL-300, FT-1000, FT-2000, FT-3000, and the like and potassium titanate available from Otsuka Chemical Co., Ltd. under the tradename designations Tismo D, Tismo L, Tismo N, WK-200, WK-200 B, WK-300, WK-300 R, and the like.

The amount of the acicular pigment used is preferably 20 to 300 parts by weight, more preferably 25 to 200 parts by weight, based on 100 parts by weight of a resin (which will be described later) for the formation of the intermediate layer. When the amount of the acicular pigment used is below the above-defined range, the reinforcement effect of the formed intermediate layer is not satisfactory and, in addition, the effect of preventing cracking attained by the intermediate layer is not satisfactory. On the other hand, when the amount of the acicular pigment used is above the above-defined range, the coatability of a coating liquid for the formation of the intermediate layer is poor.

An actual coating strength was experimentally determined as a model by preparing a 30 $\mu$m-thick coating using a coating liquid for an intermediate layer 1 in Example 1A, which will be described later, and measuring the coating strength with a Tensilon tensile tester. As a result, when particulate titanium oxide was used as the pigment, the coating strength was 3.5 N (sample width 10 mm, tensile speed 5 mm/min), whereas, when acicular crystal titanium oxide was used, the coating strength was 11.0 N (sample width 10 mm, tensile speed 5 mm/min), that is, about three times higher than the coating strength in the case where the particulate titanium oxide was used.

Further, in the present invention, the use of flaky inorganic particles, together with the acicular pigment, can further improve the effect of the present invention. Preferred flaky inorganic particles usable herein include talc which is available from Nippon Talc Co., Ltd. under the trade-name designations L-1, LG, P-3, P-4, P-5, P-6, C-3, SG-2000, SG-1000, SG-200, SG-95 and the like. The mixing ratio of acicular pigment/talc is preferably 67/33 to 50/50. The amount of the flaky particles used is 20 to 300 parts by weight, preferably 25 to 200 parts by weight, based on 100 parts by weight of the resin constituting the intermediate layer.

Urethane, polyolefin, polyester, acrylic, and epoxy adhesive resins may be mentioned as the binder resin for the formation of the intermediate layer. For resins having active hydrogen among these resins, isocyanate crosslinked products thereof may be used as the binder. Further, from the viewpoint of avoiding troubles such as blurring of images, resins having a Tg value of 40° C. or above are preferred.

In the present invention, in particular when potassium titanate is used as the acicular pigment, the whiteness and opaqueness of potassium titanate are unsatisfactory. In this case, fillers, such as titanium oxide, zinc oxide, magnesium carbonate, and calcium carbonate which are white pigments, may be added to impart whiteness and opaqueness to the intermediate layer. For the mixing ratio by mass of these fillers to potassium titanate, potassium titanate/white pigment is 30/70 to 70/30, preferably 33/67 to 50/50. On the other hand, acicular titanium oxide has satisfactory whiteness and opaqueness. Therefore, when acicular titanium oxide is used as the acicular pigment, the acicular titanium oxide is preferably used solely.

The intermediate layer constituting the second thermal transfer image-receiving sheet according to the present invention is a resin layer containing flaky particles having a thickness which is not more than the half of the diameter of the flaky particles, preferably the half to one-twentieth of the diameter of the flaky particles. The average particle diameter [D50] of these flaky particles as measured by laser diffractometry is preferably not more than 6.0 $\mu$m, more preferably 0.9 to 5.1 $\mu$m. Among these flaky particles, flaky talc particles are available from Nippon Talc Co., Ltd. under the trade-name designations L-1, LG, P-3, P-4, P-5, P-6, C-3, SG-2000, SG-1000, SG-200, SG-95, and the like and these products may be used in the present invention. Mica is available from CO-OP CHEMICAL CO., LTD. under the trade-name designations MK-100 and the like and from Tsuchiya Kaolin Co., Ltd. under the trade-name designations A-11 and the like, and these products may be used in the present invention.

The binder resin used in the intermediate layer may be the same as that used in the first thermal transfer image-receiving sheet. The amount of the flaky particles used is 20 to 100 parts by weight, preferably 25 to 100 parts by weight, based on 100 parts by weight of the resin constituting the intermediate layer.

Further, in the present invention, in order to impart the whiteness and the opaqueness, fillers, such as titanium oxide, zinc oxide, magnesium carbonate, calcium carbonate, and potassium titanate which are white pigments, may be added to the intermediate layer. For the mixing ratio of the flaky particles to the white pigment, flaky particles/white pigment is 30/70 to 70/30, preferably 33/67 to 50/50.

Further, in the first and second thermal transfer image-receiving sheets according to the present invention, brightening agents, such as stilbene compounds, benzimidazole compounds, and benzoxazole compounds, may be added to the intermediate layer to enhance the whiteness of the intermediate layer; hindered amine compounds, hindered phenol compounds, benzophenone compounds, benzotriazole compounds and the like may be added as ultraviolet absorbers or antioxidants to enhance the lightfastness of the prints; or cationic acrylic resins, polyaniline resins, various conductive fillers and the like may be added to impart antistatic properties.

Two intermediate layers may be provided. When the two layers are provided, the addition of the acicular pigment to the intermediate layer near the substrate can offer excellent cracking preventive effect. Further, white pigments, ultraviolet absorbers, antioxidants, and various conductive fillers may be added to this intermediate layer from the viewpoint of imparting whiteness, cushioning properties, opaqueness, anticurling properties, antistatic properties and the like to the intermediate layer. When the acicular pigment is also added to the second intermediate layer, the effect can be enhanced. From the viewpoints of cost and the maintenance of gloss of the image-receiving paper, however, the amount of the acicular pigment added is preferably 10 to 50 parts by weight, more preferably 10 to 25 parts by weight, based on 100 parts by weight of the resin for the formation of the intermediate layer.

The intermediate layer may be formed by dissolving or dispersing the above resin and additives in a suitable organic solvent, such as acetone, ethyl acetate, methyl ethyl ketone, toluene, xylene, or cyclohexanone, or dispersing the above resin and additives in a mixed solvent composed of water and an alcohol, such as water/IPA (isopropyl alcohol) or water/ethanol, to prepare an ink (a coating liquid), coating the ink onto at least one side of the substrate sheet by a conventional method, for example, gravure printing, screen printing, or reverse roll coating using a gravure plate, drying the coating, and, if necessary, performing crosslink-curing the coating. The coverage of the intermediate layer thus formed is in the range of 0.5 to 10.0 g/m$^2$, preferably in the range of 1.0 to 3.0 g/m$^2$, on a solid basis. When the thickness of the intermediate layer is below the above-defined range, properties required of the intermediate layer cannot be provided. On the other hand, when the thickness of the intermediate layer is above the above-defined range, the effect of the intermediate layer is saturated and, in addition, the cost is disadvantageously increased.

Receptive Layer

The dye-receptive layer provided on the upper surface of the intermediate layer functions to receive a sublimable dye transferred from the thermal transfer sheet and to hold the formed thermally transferred image. Examples of resins usable in the receptive layer include: halogenated polymers such as polyvinyl chloride and polyvinylidene chloride; vinyl resins such as polyvinyl acetate, ethylene-vinyl acetate copolymer, vinyl chloride-vinyl acetate copolymer, polyacrylic ester, polystyrene, and polystyrene-acryl resin; acetal resins such as polyvinyl formal, polyvinyl butyral, and polyvinyl acetal; various polyester resins such as saturated or unsaturated polyesters; polycarbonate resins; cellulosic resins such as cellulose acetate; polyolefin resins; urea resins; and polyamide resins such as melamine resins and benzoguanamineresins. These resins may be used either solely or as a blend of two or more of them so far as they are compatible with each other.

In the formation of the receptive layer, a release agent is preferably added to prevent fusing between the dye layer in the thermal transfer sheet and the receptive layer in the thermal transfer image-receiving sheet at the time of thermal transfer. Release agents, which are preferred for mixing into the resin, include silicone oils, phosphate surfactants, and fluorosurfactants. Among them, silicone oils are preferred. Preferred silicone oils include modified silicone oils, such as epoxy-modified, alkyl-modified, amino-modified, carboxyl-modified, alcohol-modified, fluorine-modified, alkylaralkylpolyether-modified, epoxy-polyether-modified, and polyether-modified silicone oils.

One release agent or two or more release agents may be used. Further, a product of a reaction of a vinyl-modified silicone oil with a hydrogen-modified silicone oil, a cured product prepared by reacting a plurality of modified silicone oils, such as a cured product produced by reacting an amino-modified silicone oil with an epoxy-modified silicone oil, and a cured product produced by reacting an active hydrogen-containing modified silicone oil with a curing agent reactive with the active hydrogen may also be used. The amount of the release agent added is preferably 0.5 to 30 parts by weight based on 100 parts by weight of the resin for the formation of the dye-receptive layer. When the amount of the release agent added is below the above-defined range, disadvantageously, for example, fusing between the thermal transfer sheet and the dye-receptive layer or a lowering in sensitivity in printing sometimes occurs. The addition of the release agent to the dye-receptive layer permits the release agent to bleed out on the surface of the receptive layer after the transfer to form a release layer.

When an image is formed on the receptive layer according to the present invention by using a thermal transfer sheet using, as the dye, a dye capable of forming a complex with a metal, the receptive layer may contain a complex compound of a transition metal ion as a metal source. Examples of the metal source usable in the present invention include compounds represented by formula (1):

$$M^{2+}(X)_n 2Y^- \quad (1)$$

wherein $M^{2-}$ represents a divalent transition metal ion; X represents a coordination compound which can be coordinated to the transition metal ion $M^{2+}$ to form a complex; n is an integer of 2 or 3; a plurality of coordination compounds Xs may be the same or different; and $Y^-$ represents a counter ion of the transition metal ion $M^{2+}$.

In the compound represented by formula (1), as defined above, $M^{2+}$ represents a divalent transition metal ion. Transition metal ions include, for example, cobalt ($^{2+}$), nickel ($^{2+}$), copper ($^{2+}$), zinc ($^{2+}$), and iron ($^{2+}$). Among them, nickel ($^{2+}$), copper ($^{2+}$), and zinc ($^{2+}$) are particularly preferred. In the compound represented by formula (1), $(X)_n$ represents two or three coordination compounds which can be coordinated to a transition metal to form a complex. These coordination compounds may be selected from coordination compounds described, for example, in "Kireto Kagaku (Chelate Chemistry) (5)," edited by Nan'un-do Co., Ltd. Among them, ethylenediamine derivatives, picolineamide derivatives, 2-aminomethylpiperidine derivatives, and glycineamide derivatives are preferred. Ethylenediamine derivatives and glycineamide derivatives are particularly preferred.

In the compound represented by formula (1), as described above, $Y^-$ represents a counter anion of the transition metal ion $M^{2+}$. This counter anion is an organic or inorganic anion. Particularly preferred are compounds which can render the complex of the transition metal ion $M^{2+}$ with the coordination compound $(X)_n$ soluble, for example, in an organic solvent such as methyl ethyl ketone or tetrahydrofuran (THF) . Specific examples of counter anions include organic salts of alkylcarboxylic acids, arylcarboxylic acids, alkylsulfonic acids, arylsulfonic acids, alkylphosphoric acids, arylphosphoric acids, and arylboric acids. Among them, salts of arylboric acids, arylsulfonic acids and the like are particularly preferred.

The receptive layer according to the present invention preferably contains a metal source represented by formula (2):

$$M^{2+}(X^-)_2 \quad (2)$$

wherein $M^{2+}$ represents a divalent transition metal ion; $X^-$ represents a coordination compound represented by formula (1); and the compound represented by formula (2) may contain a neutral ligand depending upon the center metal, and representative ligands include $H_2O$ and $NH_3$. Further, coordination compounds, wherein, in the metal source represented by formula (2), X is represented by formula (3), may also be mentioned.

(3)

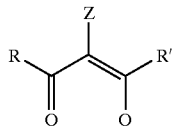

In the compound represented by formula (3), Z represents an alkyl, aryl, alkoxy, acyl, alkoxycarbonyl, aryloxycarbonyl, or carbamoyl group or a halogen or hydrogen atom. Z preferably represents an electron-withdrawing group, such as an aryloxycabonyl group, an alkoxycarbonyl group, or a halogen atom, for stabilizing the metal ion-donating compound. Among them, aryloxycarbonyl and alkoxycarbonyl groups are more preferred from the viewpoint of solubility. Aryloxycarbonyl groups include phenoxycarbonyl groups. Alkoxycarbonyl groups include straight-chain or branched alkoxycarbonyl groups having 1 to 20 carbon atoms, such as methoxycarbonyl, ethoxycarbonyl, pentyloxycarbonyl, and 2-ethylhexyloxycarbonyl groups. These alkoxycarbonyl groups may be substituted, for example, by a halogen atom or an aryl or alkoxy group.

R and R', which may be the same or different, represent an alkyl or aryl group. R may be bonded to Z to form a ring, or R' may be bonded to Z to form a ring. In this case, when Z represents a hydrogen atom, both R and R' do not simultaneously represent a methyl group. Examples of the alkyl group represented by Z, R, and R' include straight-chain or branched alkyl groups having 1 to 20 carbon atoms, such as methyl, ethyl, propyl, isopropyl, butyl, sec-butyl, t-butyl, hexyl, octyl, and 2-ethylhexyl groups. These alkyl groups may be substituted, for example, by a halogen atom or an aryl or alkoxy group.

Examples of the aryl group represented by Z, R, and R' include phenyl and naphthyl groups which may be substituted. Examples of the alkoxy group represented by Z include straight-chain or branched alkoxy groups having 1 to 20 carbon atoms, such as a metoxy, ethoxy, or butoxy group. Examples of the acyl group represented by Z include acetyl, propionyl, chloroacetyl, phenacetyl, and benzoyl groups. The halogen atom represented by Z is preferably a chlorine atom.

The amount of the metal source added in the present invention is preferably 20 to 50% by weight, more preferably 25 to 40% by weight, based on the binder resin in the receptive layer. In the present invention, the metal source is not limited to those represented by formulae (1) and (2).

The receptive layer may be formed by adding necessary additives, such as release agents, to the above resin, dissolving the mixture in a suitable organic solvent or dispersing the mixture in a suitable organic solvent or water, coating the solution or the dispersion onto the upper surface of the intermediate layer by formation means, for example, gravure printing, screen printing, or reverse roll coating using a gravure plate, and drying the coating. The coverage is in the range of 1.5 to 15 g/m$^2$, preferably in the range of 1.5 to 5.0 g/m$^2$.

The thermal transfer image-receiving sheet of the present invention is characterized by the intermediate layer, and the receptive layer is not particularly limited. If possible, the receptive layer is preferably formed of a colorless, highly transparent resin.

Backside Layer

Further, any conventional backside layer may be provided on the surface of the substrate sheet remote from the receptive layer from the viewpoint of imparting suitable carriability, writing quality, stain-resistant properties, anticurling properties, antistatic properties and the like. For the antistatic properties, an antistatic layer containing a conventional antistatic agent may be additionally provided on the receptive layer and the backside layer.

An image may be formed on the thermal transfer image-receiving sheet according to the present invention by using a thermal dye sublimation transfer sheet comprising a substrate film and single color or multicolor sublimable dye-containing dye layers provided on the surface of the substrate film. These thermal dye sublimation transfer sheets are well known in the art, and any commercially available thermal transfer sheet may be used. Printers usable for this printing are also well known in the art, and any commercially available printer may be used. For example, a desired monocolor or full-color image can be formed by imparting a thermal energy of about 5 to 100 mJ/mm$^2$ by controlling a recording time using a recording apparatus such as a thermal printer, for example, a digital color printer P-400, manufactured by Olympus Optical Co., LTD. A protective layer may be formed on the surface of the formed print. For example, the formation of the image may be followed by the transfer and formation of a protective layer using a conventional protective layer transfer film or a composite thermal transfer sheet comprising a dye layer and a protective layer provided in a face serial manner.

EXAMPLES

The first thermal transfer image-receiving sheet according to the present invention will be described in more detail with reference to the following examples and comparative examples. In the following description, "parts" or "%" is by weight unless otherwise specified.

Example 1A

Coating liquids having the following compositions were coated on one side of the following substrate at predetermined coverages on a dry basis, followed by drying to form a first thermal transfer image-receiving sheet according to the present invention.

Substrate

150 μm-thick synthetic paper manufactured by Yupo Corporation

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 72.3 parts |
| Acicular titanium oxide (FTL 100, manufactured by Ishihara Sangyo Kaisha Ltd., average length 1.68 μm, average diameter 0.13 μm) | 15.0 parts |
| Water | 6.3 parts |
| IPA | 6.4 parts |
| Coverage on dry basis = 1.5 g/m$^2$ | |
| Coating liquid for intermediate layer 2: | |
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |
| Coating liquid for receptive layer: | |
| Vinyl chloride-vinyl acetate copolymer (1000 GK, manufactured by Denki Kagaku Kogyo K.K.) | 14.0 parts |
| Metal source (chemical formula 4) | 6.0 parts |
| Fluorosurfactant (FC-431, manufactured by Sumitomo 3M Ltd.) | 5.0 parts |
| Epoxy-modified silicone (X 22-3000 T, manufactured by The Shin-Etsu Chemical Co., Ltd.) | 1.5 parts |
| Methyl ethyl ketone | 80.0 parts |
| Coverage on dry basis = 2.5 g/m$^2$ | |

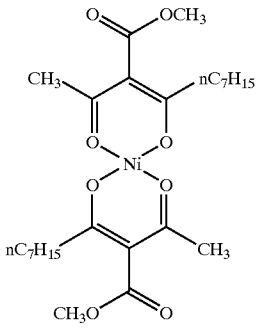

Example 1B

Coating liquids having the following compositions were coated on one side of the following substrate at predetermined coverages on a dry basis, followed by drying to form a first thermal transfer image-receiving sheet according to the present invention.

Substrate: Same as used in Example 1A

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 64.2 parts |
| Potassium titanate (Tismo N, manufactured by Otsuka Chemical Co., Ltd., average length 15.0 μm, average diameter 0.45 μm) | 12.0 parts |
| Titanium oxide (TCA-888, manufactured by Sakai Chemical Co., Ltd., particulate form) | 12.0 parts |
| Water | 5.9 parts |
| IPA | 5.9 parts |
| Coverage on dry basis = 1.5 g/m$^2$ | |
| Coating liquid for intermediate layer 2: | |
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Coating Liquid for Receptive Layer: Same as Used in Example 1A

Example 1C

Coating liquids having the following compositions were coated on one side of the following substrate at predetermined coverages on a dry basis, followed by drying to form a first thermal transfer image-receiving sheet according to the present invention.

Substrate: Same as used in Example 1A

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 64.2 parts |
| Acicular titanium oxide (FTL 100, manufactured by Ishihara Sangyo Kaisha Ltd., average length 1.68 μm, average diameter 0.13 μm) | 12.0 parts |
| Talc (SG 2000, manufactured by Nippon Talc Co., Ltd., particle diameter 1.0 μm) | 12.0 parts |
| Water | 5.9 parts |
| IPA | 5.9 parts |
| Coverage on dry basis = 1.5 g/m$^2$ | |
| Coating liquid for intermediate layer 2: | |
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Coating Liquid for Receptive Layer: Same as Used in Example 1A

Example 1D

Coating liquids having the following compositions were coated on one side of the following substrate at predetermined coverages on a dry basis, followed by drying to form a first thermal transfer image-receiving sheet according to the present invention.

Substrate: Same as Used in Example 1A

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 64.2 parts |
| Potassium titanate (Tismo N, manufactured by Otsuka Chemical Co., Ltd., average length 15.0 μm, average diameter 0.45 μm) | 12.0 parts |
| Talc (SG 2000, manufactured by Nippon Talc Co., Ltd., particle diameter 1.0 μm) | 12.0 parts |
| Water | 5.9 parts |
| IPA | 5.9 parts |
| Coverage on dry basis = 1.5 g/m$^2$ | |
| Coating liquid for intermediate layer 2: | |
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Coating Liquid for Receptive layer: Same as Used in Example 1A

Example 1E

Coating liquids having the following compositions were coated on one side of the following substrate at predetermined coverages on a dry basis, followed by drying to form a first thermal transfer image-receiving sheet according to the present invention.

Substrate: Same as Used in Example 1A

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 72.3 parts |
| Acicular titanium oxide (FTL 100, manufactured by Ishihara Sangyo Kaisha Ltd., average length 1.68 μm, average diameter 0.13 μm) | 15.0 parts |
| Water | 6.3 parts |
| IPA | 6.4 parts |
| Coating liquid for intermediate layer 2: | |
| Polyurethane resin (Hydran AP-40, manufactured by Dainippon Ink and Chemicals, Inc., Tg = 49° C.) | 90.9 parts |
| Acicular titanium oxide (FTL 100, manufactured by Ishihara Sangyo Kaisha Ltd., average length 1.68 μm, average diameter 0.13 μm) | 5.0 parts |
| Water | 27.0 parts |
| IPA | 27.1 parts |
| Coverage on dry basis = 1.5 g/m$^2$ | |

Coating Liquid for Receptive Layer: Same as Used in Example 1A

Example 1F

Coating liquids having the following compositions were coated on one side of the following substrate at predetermined coverages on a dry basis, followed by drying to form a first thermal transfer image-receiving sheet according to the present invention.

Substrate: Same as Used in Example 1A

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 72.3 parts |
| Potassium titanate (Tismo D, manufactured by Otsuka Chemical Co., Ltd., average length 15.0 μm, average diameter 0.45 μm) | 15.0 parts |
| Water | 6.3 parts |
| IPA | 6.4 parts |
| Coverage on dry basis = 1.5 g/m$^2$ | |
| Coating liquid for intermediate layer 2: | |
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Coating Liquid for Receptive Layer: Same as Used in Example 1A

Example 1G

Coating liquids having the following compositions were coated on one side of the following substrate at predetermined coverages on a dry basis, followed by drying to form a first thermal transfer image-receiving sheet according to the present invention.

Substrate: Same as Used in Example 1A

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 64.2 parts |
| Potassium titanate (Tismo D, manufactured by Otsuka Chemical Co., Ltd., average length 15.0 μm, average diameter 0.45 μm) | 24.0 parts |
| Water | 5.9 parts |
| IPA | 5.9 parts |
| Coverage on dry basis = 1.5 g/m$^2$ | |
| Coating liquid for intermediate layer 2: | |
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Coating Liquid for Receptive Layer: Same as Used in Example 1A

Example 1H

Coating liquids having the following compositions were coated on one side of the following substrate at predetermined coverages on a dry basis, followed by drying to form a first thermal transfer image-receiving sheet according to the present invention.

Substrate: Same as Used in Example 1A

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 64.2 parts |
| Acicular titanium oxide (FTL 100, manufactured by Ishihara Sangyo Kaisha Ltd., average length 1.68 μm, average diameter 0.13 μm) | 24.0 parts |
| Water | 5.9 parts |
| IPA | 5.9 parts |
| Coverage on dry basis = 1.5 g/m$^2$ | |
| Coating liquid for intermediate layer 2: | |
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Coating Liquid for Receptive Layer: Same as Used in Example 1A

Example 1I

Coating liquids having the following compositions were coated on one side of the following substrate at predetermined coverages on a dry basis, followed by drying to form a first thermal transfer image-receiving sheet according to the present invention.

Substrate: Same as Used in Example 1A

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 72.3 parts |
| Acicular titanium oxide (FTL 100, manufactured by Ishihara Sangyo Kaisha Ltd., average length 1.68 μm, average diameter 0.13 μm) | 7.5 parts |
| Talc (SG 2000, manufactured by Nippon Talc Co., Ltd., particle diameter 1.0 μm) | 7.5 parts |
| Water | 6.3 parts |
| IPA | 6.4 parts |
| Coverage on dry basis = 1.5 g/m$^2$ | |
| Coating liquid for intermediate layer 2: | |
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Coating Liquid for Receptive Layer: Same as Used in Example 1A

Comparative Example 1A

Coating liquids having the following compositions were coated on one side of the following substrate at predetermined coverages on a dry basis, followed by drying to form a thermal transfer image-receiving sheet of Comparative Example 1A.

Substrate: Same as Used in Example 1A

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 72.7 parts |
| White pigment (TCA-888, manufactured by Sakai Chemical Co., Ltd., particulate form) | 16.0 parts |
| Water | 5.6 parts |
| IPA | 5.7 parts |
| Coverage on dry basis = 1.5 g/m$^2$ | |
| Coating liquid for intermediate layer 2: | |
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Coating Liquid for Receptive Layer: Same as Used in Example 1A

Comparative Example 1B

Coating liquids having the following compositions were coated on one side of the following substrate at predetermined coverages on a dry basis, followed by drying to form a thermal transfer image-receiving sheet of Comparative Example 1B.

Substrate: Same as Used in Example 1A

Coating Liquid for Intermediate Layer 1 (Near-substrate Side)

| | |
|---|---|
| Polyurethane resin (Hydran AP-40, manufactured by Dainippon Ink and Chemicals, Inc., Tg = 49° C.) | 72.7 parts |
| Talc (SG 2000, manufactured by Nippon Talc Co., Ltd., particle diameter 1.0 μm) | 16.0 parts |
| Water | 5.6 parts |
| IPA | 5.7 parts |
| Coverage on dry basis = 1.5 g/m$^2$ | |
| Coating liquid for intermediate layer 2: | |
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |

Coating Liquid for Receptive Layer: Same as Used in Example 1A

Examples of Use

Each of the thermal transfer image-receiving sheets prepared in Examples 1A to 1E and Comparative Examples 1A and 1B was used with a thermal cyan transfer sheet using the following cyan dye and a protective layer in a commercially available integral-type thermal transfer sheet with a YMC protective layer to print images. Thus, prints were prepared.

Commercially available ribbon: OP part of an ink ribbon pack P-RBN attached to a printer P-400 manufactured by Olympus Optical Co., LTD.

Thermal cyan transfer sheet: Prepared as follows.

Composition of Coating Liquid for Dye Layer Substrate

| | |
|---|---|
| 6 μm-thick PET film with backside layer | |
| Coating liquid for cyan dye layer: | |
| Chelate dye (formula 5) | 4.0 parts |
| Polyvinyl butyral resin | 4.0 parts |
| Methyl ethyl ketone | 46.0 parts |
| Toluene | 46.0 parts |
| Coverage on dry basis = 1.0 g/m$^2$ | |

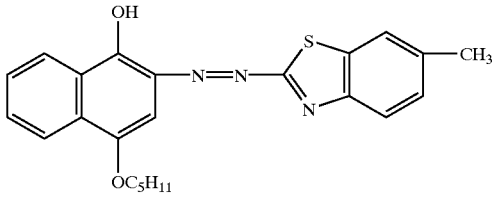

Method for Formation of Prints

The above commercially available thermal transfer sheet or the above-prepared thermal transfer sheet was put on top of the image-receiving sheet so that the dye layer portion faced the receptive layer portion. They were brought into pressure contact with each other by means of a thermal head with a resolution of 12 dots/mm and an average resistance of 3100Ω and a platen roller, and heating was carried out from the backside of the dye layer portion under conditions of printing energy 80 mJ/mm$^2$ and feed rate 10 msec/line to form a cyan blotted image pattern on the receptive layer. Next, the protective layer was put on top of the receptive layer with an image formed thereon. They were brought into pressure contact with each other by means of the same thermal head and platen roller as used above. Heating was then carried out from the backside of the protective layer portion under conditions of printing energy 80 mJ/mm$^2$ and feed rate 10 msec/line to transfer the protective layer onto the receptive layer. Thus, a cyan blotted image was formed. The reason why the cyan blotted image was used as an evaluation image is that, upon cracking, the dye in the cracked portion is transferred to a sebum component and, as a result, color dropouts occur to provide distinct contrast.

Test Method

Sebum was collected by rubbing the nose or forehead of a human with a finger and the finger with the sebum deposited thereon was pressed against the print for several seconds to transfer the sebum onto the print. In this state, the print was allowed to stand in room temperature environment for inspection. Further, to examine an individual difference, sebum of several persons was deposited on the print in the same manner as described above. As a result, it was found that there was no individual difference in cracking behavior.

Results of Evaluation

◎: Not cracked for more than 96 hr

○: Cracked in 60 to 96 hr (in this cracking time level, when the print is handled with the hand as usual, the dye image is not cracked at all)

Δ: Cracked in 36 to 60 hr

X: Cracked within 36 hr

Example 1A: ○ (two or three small cracks in 84 hr)

Example 1B: ◎ (no crack even in 230 hr)

Example 1C: ◎ (two or three small cracks in 160 hr)

Example 1D: ◎ (no crack even in 230 hr)

Example 1E: ◎ (no crack even in 230 hr)

Example 1F: ○ (two or three small cracks in 72 hr)

Example 1G: ○ (two or three small cracks in 64 hr)

Example 1H: ○ (two or three small cracks in 64 hr)

Example 1I: ○ (two or three small cracks in 64 hr)

Comparative Example 1A: X (reticulate cracks in 36 hr)

Comparative Example 1B: Δ (reticulate cracks in 48 hr)

Next, the second thermal transfer image-receiving sheet of the present invention will be described in more detail with reference to the following examples and comparative examples.

Example 2A

Substrate

| | |
|---|---|
| Substrate: | |
| 150 μm-thick synthetic paper, manufactured by Yupo Corporation | |
| Intermediate layer: | |
| Polyurethane resin (Hydran AP-40, manufactured by Dainippon Ink and Chemicals, Inc., Tg = 49° C.) | 72.7 parts |
| Talc (Microace L1, manufactured by Nippon Talc Co., Ltd., particle diameter 4.9 μm) | 16.0 parts |
| Water | 30.6 parts |
| IPA | 30.7 parts |
| Coverage on dry basis = 3 g/m$^2$ | |
| Receptive layer: | |
| Vinyl chloride-vinyl acetate copolymer (1000 A, manufactured by Denki Kagaku Kogyo K.K.) | 20.0 parts |
| Phenyl-modified silicone (X 24-510, manufactured by The Shin-Etsu Chemical Co., Ltd.) | 1.0 part |
| Epoxy-modified silicone (X 22-3000 T, manufactured by The Shin-Etsu Chemical Co. , Ltd.) | 0.3 part |
| Methyl ethyl ketone | 40.0 parts |
| Toluene | 40.0 parts |
| Coverage on dry basis = 4.5 g/m$^2$ | |

Example 2B

Substrate: Same as Used in Example 2A

Intermediate Layer

| | |
|---|---|
| Polyester resin (PE-723, manufactured by Futaba Fine Chemical Company, Tg = 68° C.) | 72.5 parts |
| PVA (Gosenol KM 11, manufactured by Nippon Synthetic Chemical Industry Co., Ltd.) | 3.3 parts |
| Talc (Microace P3, manufactured by Nippon Talc Co., Ltd., particle diameter 5.1 μm) | 10.0 parts |
| Water | 32.1 parts |
| IPA | 32.1 parts |
| Coverage on dry basis = 1.5 g/m$^2$ | |

Receptive Layer: Same as Used in Example 2A

Example 2C

Substrate: Same as Used in Example 2A

Intermediate Layer

| | |
|---|---|
| Polyester resin (PE-723, manufactured by Futaba | 72.5 parts |

-continued

| | |
|---|---|
| Fine Chemical Company, Tg = 68° C.) | |
| PVA (Gosenol KM 11, manufactured by Nippon Synthetic Chemical Industry Co., Ltd.) | 3.3 parts |
| Mica (Micro Mica MK 100 F, manufactured by CO-OP CHEMICAL CO., LTD., average particle diameter 4.0 μm) | 10.0 parts |
| Water | 32.1 parts |
| IPA | 32.1 parts |
| Coverage on dry basis = 1.5 g/m$^2$ | |

Receptive Layer: Same as Used in Example 1

Example 2D

Substrate: Same as Used in Example 2A

Intermediate layer 1 (Near-substrate Side)

| | |
|---|---|
| Polyurethane resin (Hydran AP-40, manufactured by Dainippon Ink and Chemicals, Inc., Tg = 49° C.) | 72.7 parts |
| Talc (Microace L1, manufactured by Nippon Talc Co., Ltd., particle diameter 4.9 μm) | 16.0 parts |
| Water | 30.6 parts |
| IPA | 30.7 parts |
| Coverage on dry basis = 1.5 g/m$^2$ | |

Intermediate Layer 2

| | |
|---|---|
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |
| Receptive layer: | |
| Vinyl chloride-vinyl acetate copolymer (1000 GK, manufactured by Denki Kagaku Kogyo K.K.) | 14.0 parts |
| Metal source (same as used in Example 1A) | 6.0 parts |
| Fluorosurfactant (FC-431, manufactured by Sumitomo 3M Ltd.) | 5.0 parts |
| Epoxy-modified silicone (X 22-3000 T, manufactured by The Shin-Etsu Chemical Co., Ltd.) | 1.5 parts |
| Methyl ethyl ketone | 80.0 parts |
| Coverage on dry basis = 2.5 g/m$^2$ | |

Example 2E

Substrate: Same as Used in Example 2A

Intermediate Layer 1 (Near-substrate Side)

| | |
|---|---|
| Polyurethane resin (Hydran AP-40, manufactured by Dainippon Ink and Chemicals, Inc., Tg = 49° C.) | 72.3 parts |
| Talc (Microace L1, manufactured by Nippon Talc Co., Ltd., particle diameter 4.9 μm) | 5.3 parts |
| White pigment (titanium oxide) | 10.6 parts |
| Water | 30.9 parts |
| IPA | 30.9 parts |
| Coverage on dry basis = 1.5 g/m$^2$ | |

Intermediate Layer 2

| | |
|---|---|
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Receptive Layer: Same as Used in Example 2D

Example 2F

Substrate: Same as Used in Example 2A

Intermediate Layer 1 (Near-substrate Side)

| | |
|---|---|
| Polyurethane resin (Hydran AP-40, manufactured by Dainippon Ink and Chemicals, Inc., Tg = 49° C.) | 72.7 parts |
| Talc (Microace L1, manufactured by Nippon Talc Co., Ltd., particle diameter 4.9 μm) | 8.0 parts |
| White pigment (titanium oxide) | 8.0 parts |
| Water | 30.6 parts |
| IPA | 30.7 parts |
| Coverage on dry basis = 1.5 g/m$^2$ | |

Intermediate Layer 2

| | |
|---|---|
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Receptive Layer: Same as Used in Example 2D

Example 2G

Substrate: Same as Used in Example 2A

Intermediate Layer 1 (Near-substrate Side)

| | |
|---|---|
| Polyurethane resin (Hydran AP-40, manufactured by Dainippon Ink and Chemicals, Inc., Tg = 49° C.) | 72.7 parts |
| Talc (SG 2000, manufactured by Nippon Talc Co., Ltd., particle diameter 1.0 μm) | 8.0 parts |
| White pigment (titanium oxide) | 8.0 parts |
| Water | 30.6 parts |
| IPA | 30.7 parts |
| Coverage on dry basis = 1.5 g/m$^2$ | |

Intermediate Layer 2

| | |
|---|---|
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Receptive Layer: Same as Used in Example 2D

Example 2H

Substrate: Same as Used in Example 2A

Intermediate Layer 1 (Near-substrate Side)

| | |
|---|---|
| Polyester resin (Polyester WR 905, manufactured by Nippon Synthetic Chemical Industry Co., Ltd., Tg = 70° C.) | 80.0 parts |
| Talc (SG 2000, manufactured by Nippon Talc Co., Ltd., particle diameter 1.0 μm) | 16.0 parts |
| White pigment (titanium oxide) | 16.0 parts |
| Water | 19.0 parts |
| IPA | 19.0 parts |
| Coverage on dry basis = 1.5 g/m$^2$ | |

Intermediate Layer 2

| | |
|---|---|
| Polyurethane resin (Polyester WR 901, manufactured by Nippon Synthetic Chemical Industry Co., Ltd., Tg = 67° C.) | 112.5 parts |
| Water | 18.7 parts |
| IPA | 18.8 parts |
| Coverage on dry basis = 1.5 g/m$^2$ | |

Receptive Layer: Same as Used in Example 2D

Example 2I

Substrate: Same as Used in Example 2A

Intermediate Layer 1 (Near-substrate Side)

| | |
|---|---|
| Polyester resin (Polyester WR 905, manufactured by Nippon Synthetic Chemical Industry Co., Ltd., Tg = 70° C.) | 80.0 parts |
| Talc (SG 200, manufactured by Nippon Talc Co., Ltd., particle diameter 3.2 μm) | 16.0 parts |
| White pigment (titanium oxide) | 16.0 parts |
| Water | 19.0 parts |
| IPA | 19.0 parts |
| Coverage on dry basis = 1.5 g/m$^2$ | |

Intermediate Layer 2

| | |
|---|---|
| Polyurethane resin (Polyester WR 901, manufactured by Nippon Synthetic Chemical Industry Co., Ltd., Tg = 67° C.) | 112.5 parts |
| Water | 18.7 parts |
| IPA | 18.8 parts |
| Coverage on dry basis = 1.5 g/m$^2$ | |

Receptive Layer: Same as Used in Example 2D

Comparative Example 2A

| | |
|---|---|
| Polyurethane resin (Hydran, AP-40, manufactured by Dainippon Ink and Chemicals, Inc.) | 136.4 parts |
| IPA | 13.6 parts |

Receptive Layer: Same as Used in Example 2A

Comparative Example 2B

Substrate: Same as Used in Example 2A

Intermediate Layer

| | |
|---|---|
| Polyester resin (PE-723, manufactured by Futaba Fine Chemical Company, Tg = 68° C.) | 130.4 parts |
| IPA | 19.6 parts |
| Coverage on dry basis = 1.5 g/m$^2$ | |

Receptive Layer: Same as Used in Example 2A

Comparative Example 2C

Substrate: Same as Used in Example 2A

Intermediate Layer 1 (Near-substrate Side)

| | |
|---|---|
| Polyurethane resin (Hydran AP-40, manufactured by Dainippon Ink and Chemicals, Inc., Tg = 49° C.) | 72.7 parts |
| White pigment (titanium oxide) | 16.0 parts |
| Water | 30.6 parts |
| IPA | 30.7 parts |
| Coverage on dry basis = 1.5 g/m$^2$ | |

Intermediate Layer 2

| | |
|---|---|
| Polyurethane resin (Hydran AP-40, manufactured by Dainippon Ink and Chemicals, Inc., Tg = 49° C.) | 100.0 parts |
| Water | 25.0 parts |
| IPA | 25.0 parts |
| Coverage on dry basis = 1.5 g/m$^2$ | |

Receptive Layer: Same as Used in Example 2D

Comparative Example 2D

Substrate: Same as Used in Example 2A

Intermediate Layer 1 (Near-substrate Side)

| | |
|---|---|
| Polyester resin (Polyester WR 905, manufactured by Nippon Synthetic Chemical Industry Co., Ltd., Tg = 70° C.) | 80.0 parts |
| White pigment (titanium oxide) | 32.0 parts |
| Water | 19.0 parts |
| IPA | 19.0 parts |
| Coverage on dry basis = 1.5 g/m$^2$ | |

Intermediate Layer 2

| | |
|---|---|
| Polyurethane resin (Polyester WR 901, manufactured by Nippon Synthetic Chemical Industry Co., Ltd., Tg = 67° C.) | 112.5 parts |
| Water | 18.7 parts |
| IPA | 18.8 parts |
| Coverage on dry basis = 1.5 g/m$^2$ | |

Receptive Layer: Same as Used in Example 2D

Examples of Use

The thermal transfer image-receiving sheets prepared in Examples 2A to 2C and Comparative Examples 2A and 2B were used with a commercially available integral-type thermal transfer sheet with YMC and a protective layer (the ink ribbon is a cyan part in an ink ribbon pack RBN attached to a printer P-400 manufactured by Olympus Optical Co., LTD.) for printing.

On the other hand, the thermal transfer image-receiving sheets prepared in Examples 2D to 2I and Comparative Examples 2C and 2D were used with a thermal cyan transfer sheet, which was prepared as follows, for printing. In the formation of a protective layer, the protective layer in the ink ribbon attached to the printer manufactured by Olympus Optical Co., LTD. was used.

Composition of Coating Liquid for Dye Layer

The substrate sheet and the cyan dye layer were the same as those used in the examples of use of the first thermal transfer image-receiving sheets, and the coverage on a dry basis of the cyan dye layer was also the same as that in the examples of use of the first thermal transfer image-receiving sheets.

Method for Formation of Prints

The above commercially available thermal transfer sheet or the above-prepared thermal transfer sheet was put on top of the image-receiving sheet so that the surface of the dye layer faced the surface of the receptive layer. They were brought into pressure contact with each other by means of a thermal head with a resolution of 12 dots/mm and an average resistance of 3100Ω and a platen roller, and heating was carried out from the backside of the dye layer portion under conditions of printing energy 80 mJ/mm$^2$ and feed rate 10 msec/line to form a cyan blotted image pattern on the receptive layer. Next, the protective layer was put on top of the receptive layer with an image formed thereon. They were brought into pressure contact with each other by means of the same thermal head and platen roller as used above. Heating was then carried out from the backside of the protective layer portion under conditions of printing energy 80 mJ/mm$^2$ and feed rate 10 msec/line to transfer the protective layer onto the receptive layer. Thus, a cyan blotted image was formed. The reason why the cyan blotted image was used as an evaluation image is that, upon cracking, the dye in the cracked portion is transferred to a reagent and, as a result, color dropouts occur to provide distinct contrast.

Test Method

A reagent prepared by adding 20% of DOP to Vaseline was thinly coated by means of a swab or the like onto the print, and, in this state, the print was allowed to stand under room temperature environment for inspection. The results are shown in Table 1 below.

Results of Evaluation

◎: Not cracked.

Δ: Cracked in 12 to 24 hr.

X: Cracked within 12 hr.

TABLE 1

| | | Resin:flaky particle: white pigment ratio | Type of particles | Particle size, μm |
|---|---|---|---|---|
| Example 2A | ○ | 100:100:0 | Talc | 4.9 |
| Comparative Example 2A | X | 100:0:0 | — | — |
| Example 2B | ○ | 100:50:0 | Talc | 5.1 |
| Example 2C | ○ | 100:50:0 | Mica | 4.0 |
| Comparative Example 2B | Δ | 100:0:0 | — | — |
| Example 2D | ○ | 100:100:0 | Talc | 4.9 |
| Example 2E | ○ | 100:33:67 | Talc | 4.9 |
| Example 2F | ○ | 100:50:50 | Talc | 4.9 |
| Example 2G | ○ | 100:50:50 | Talc | 1.0 |
| Comparative Example 2C | X | 100:0:100 | — | — |

TABLE 1-continued

| | | Resin:flaky particle: white pigment ratio | Type of particles | Particle size, μm |
|---|---|---|---|---|
| Example 2H | ○ | 100:100:100 | Talc | 1.0 |
| Example 2I | ○ | 100:100:100 | Talc | 3.2 |
| Comparative Example 2D | Δ | 100:0:200 | — | — |

What is claimed is:

1. A thermal transfer image-receiving sheet comprising: a substrate sheet; and, provided on at least one side of the substrate sheet in the following order, an intermediate layer and a dye-receptive layer, said intermediate layer comprising a resin layer comprising an inorganic pigment having an acicular crystal structure.

2. The thermal transfer image-receiving sheet according to claim 1, wherein the content of the inorganic pigment having an acicular crystal structure in the intermediate layer is 20 to 300 parts by weight based on 100 parts by weight of the resin constituting the intermediate layer.

3. The thermal transfer image-receiving sheet according to claim 1, wherein the inorganic pigment having an acicular crystal structure is an inorganic particle comprises titanium oxide or particulate potassium titanate.

4. The thermal transfer image-receiving sheet according to claim 1, wherein the intermediate layer comprises the resin layer comprising the inorganic pigment having an acicular crystal structur, and flaky particles of talc.

5. The thermal transfer image-receiving sheet according to claim 1, wherein the resin layer comprises an adhesive resin selected from the group comprising urethane, polyolefin, polyester, acrylic and epoxy adhesive resins.

6. The thermal transfer image-receiving sheet according to claim 1, wherein the dye-receptive layer comprises a metal source comprising a complex compound of a transition metal ion.

7. A thermal transfer image-receiving sheet comprising: a substrate sheet; and, provided on at least one side of the substrate sheet in the following order, an intermediate layer and a dye-receptive layer, said intermediate layer comprising a resin layer comprising flaky particles having an average particle diameter equal to or less than 6.0 μm and a thickness equal to or less than the half of the average particle diameter.

8. The thermal transfer image-receiving sheet according to claim 7, wherein the content of the flaky particles in the intermediate layer is 20 to 100 parts by weight based on 100 parts by weight of the resin constituting the intermediate layer.

9. The thermal transfer image-receiving sheet according to claim 7, wherein the flaky particles comprise inorganic particles of talc or mica.

10. The thermal transfer image-receiving sheet according to claim 7, wherein the intermediate layer comprises the resin layer comprising the flaky particles and a white pigment comprising titanium oxide or potassium titanate.

11. The thermal transfer image-receiving sheet according to claim 7, wherein the resin layer comprises an adhesive resin selected from the group comprising urethane, polyolefin, polyester, acrylic and epoxy adhesive resins.

12. The thermal transfer image-receiving sheet according to claim 7, wherein the dye-receptive layer comprises a metal source comprising a complex compound of a transition metal ion.

* * * * *